United States Patent [19]

Isojima et al.

[11] 4,107,565

[45] Aug. 15, 1978

[54] MERCURY EMITTING STRUCTURE

[75] Inventors: Tsuyoshi Isojima, Yokohama; Kenji Enokida, Yokosuka; Hideharu Nihei, Yokohama; Wataru Ichise, Tokyo, all of Japan

[73] Assignee: Tokyo Shibaura Electric Co., Ltd., Kawasaki, Japan

[21] Appl. No.: 672,324

[22] Filed: Mar. 31, 1976

[30] Foreign Application Priority Data

Apr. 2, 1975 [JP] Japan ..... 50-39246

[51] Int. Cl.[2] ..... H01J 7/10; H01J 7/18; H01J 7/20

[52] U.S. Cl. ..... 313/174; 252/181.6

[58] Field of Search ..... 252/181.2, 181.1, 181.6; 313/174, 490; 316/3, 16

[56] References Cited

U.S. PATENT DOCUMENTS

| | | | |
|---|---|---|---|
| 1,934,369 | 11/1933 | Mendenhall | 252/181.2 X |
| 2,183,841 | 12/1939 | King | 252/181.2 X |
| 3,318,649 | 5/1967 | Keller et al. | 313/521 X |
| 3,657,589 | 4/1972 | Dellaporta et al. | 313/174 X |
| 3,737,709 | 6/1973 | Hornman et al. | 313/174 |

*Primary Examiner*—Palmer C. Demeo

*Attorney, Agent, or Firm*—Oblon, Fisher, Spivak, McClelland & Maier

[57] ABSTRACT

A mercury emitting structure with an annular receptacle having a groove at the upper end, in which a face-centered cubic lattice type intermetallic compound consisting mainly of yttrium, nickel and mercury is filled.

11 Claims, 18 Drawing Figures

FIG. 1
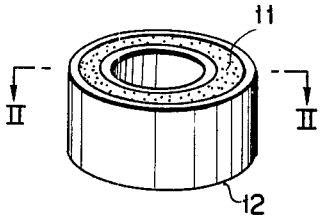
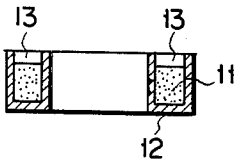
FIG. 2
FIG. 14
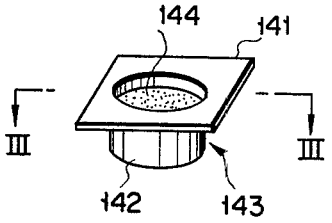
FIG. 15
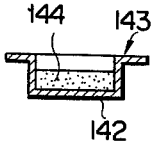
FIG. 16
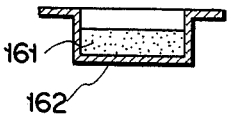
FIG. 17
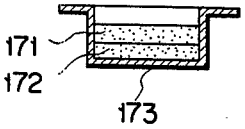
FIG. 18
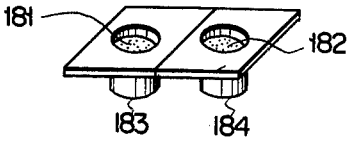

MERCURY EMITTING STRUCTURE

BACKGROUND OF THE INVENTION

This invention relates to a novel mercury emitting structure with a holder having an alloy including an intermetallic compound consisting mainly of yttrium, nickel and mercury.

Where mercury is filled in a tube such as a nixi tube and low-pressure mercury vapor discharge tube, a predetermined amount of mercury is supplied from a "mercurydoser" through supply and exhaust tubes into the tube. In the above-mentioned method, however, it is difficult to accurately seal a required amount of mercury, for example, several milligrams to tens of milligrams of mercury, into the tube, and a sealed amount of mercury is deviated, an amount of one in few parts to several-fold, from the required amount. Furthermore, a mercury consumption, as well as a raise in cost due to a mercury recovery etc., is involved and an environmental pollution at a workshop due to evaporation of mercury is also involved. These disadvantages are due mainly to the fact that mercury is treated in the form of liquid.

In order to avoid such a situation several attempts have been made to seal mercury in the form of solids into a tube. One method is to seal an alloy (i.e., amalgam) of mercury with indium, cadmium and the other metal into a tube so as to mainly regulate a mercury vapor pressure in the tube. This method is suitable for a low pressure mercury vapor discharge tube as used under a high temperature circumstance. However, this method is not employed in a tube as used in an normal circumstance, since an intra-tube mercury vapor pressure is too low. A second method is to seal a predetermined amount of inorganic compound of mercury into a tube and thermally decompose, after evacuation and sealing steps, the inorganic compound from outside of the tube (by for example, a high frequency wave heating) to liberate a predetermined amount of mercury in the tube while an unrequired gas — including, for example, oxygen, sulfur compound etc. — simultaneously emitted from the inorganic compound is reacted with a suitable metal such as titanium, zirconium, iron etc. This method is disclosed in U.S. Pat. Nos. 1,855,901 (mercury sulfide and iron are used), U.S. Pat. No. 3,230,027 and U.S. Pat. No. 3,385,644 (mercury oxide and reducing metal are used) and U.S. Pat. No. 3,401,296 (mercury pyrophosphate and reducing metal are used). These disclosed methods present difficulty from a practical viewpoint, since it is impossible to completely prevent emission of an obnoxious gas during a heating time. The third method is disclosed in U.S. Pat. Nos. 3,318,649. U.S. Pat. No. 3,318,649 discloses the use of an alloy formed from mercury and a metal selected from groups IA, IIA or III including the lanthanides and actinides of the periodic table. Although the rare earth metals are disclosed in this patent, no detailed example is disclosed therein. This patent also discloses the concept of making an alloy of magnesium and mercury stabilized by the use of nickel. Where the above-mentioned alloy is sealed in a tube and heated by a high frequency wave, magnesium is evaporated at a temperature of 600° to 700° C due to its high vapor pressure and, in consequence, it is not turned to advantage from the practical viewpoint. The fourth method is disclosed in an article of "Journal of Metals" by P. Pietrokowsky (February 1954). This article discloses a mercury emitting getter in a holder in which an intermetallic compound of titanium, zirconium and mercury — for example, a thermally stable metal compound such as TiHg, ZrHg, $\gamma$-$Ti_3Hg$, $\delta$-$Ti_3Hg$ etc. — is received. Such a mercury emitting getter is disclosed in U.S. Pat. Nos. 3,733,194, U.S. Pat. No. 3,772,976 and U.S. Pat. No. 3,657,589 and Japanese Patent No. 5659/1974. Recently, such mercury emitting getter is commercially available under the name of "GEMEDIS" (S.A.E.S. Getters S.pA., Italy). This getter is a Nickel-plated iron ribbon with $Ti_3Hg$ compression-bonded on one surface side thereof and Zr-Al based alloy compression-bonded on the other surface side thereof. The "GEMEDIS" has a disadvantage that at a lower temperature a mercury emitting speed is slow due to the presence of the mercury emitting getter and at a higher temperature a metal, constituting a ribbon-like holder for holding the mercury emitting getter, is easily evaporated.

A technical report TR-22, p5 (FIG. 5), issued by S.A.E.S. Getters S.p.A., Italy, shows that in order to effect a 90% mercury emission the mercury emitting getter should be heated for 10 minutes at a temperature of 900° C under a vacuum of $10^{-4}$ mmHg. However, such getter can not be applied to a high-speed tube manufacturing equipment in which a tube is manufactured at the rate of one per a few seconds. The technical report further shows on page 5 that, when the mercury emitting getter is heated for 15 to 30 seconds at a temperature of 900° C ±100° C, a 70 to 80% mercury emission can be obtained. Since the "GEMEDIS" has an intermetallic compound of mercury held by the nickel-plated iron ribbon-like holder, if the holder is too heated, nickel is evaporated and deposited on a phosphor-coated tube wall and cathode, resulting in lowered tube characteristics. If the evaporated nickel is deposited onto the cathode, a cathode emission characteristic is degraded with the resultant raised starting voltage. If, on the other hand, the evaporated nickel is deposited onto the tube wall, smears are formed on the phosphor-coated tube wall with the result that a light emitting characteristic, brightness characteristic etc. are lowered. Furthermore, it is difficult, from the standpoint of a tube manufacture, to severely regulate the mounting position of the holder to a mount. When the holder is heated by a high frequency wave from outside of the tube, difficulty is encountered in effecting the uniform heating of the holder and the holder is heated in varying temperature dependent upon the mounting position. If, therefore, the holder is not set to a temperature below 900° C, it is overheated and nickel tends to be evaporated. Suppose that the mercury getter is applied to a low-pressure mercury vapor discharge tube. Since in this case an inert gas such as an argon gas is sealed under a vapor pressure of about 2 to 3 mmHg into the tube, the mercury vapor pressure is slower than that disclosed in the above-mentioned technical report. Even under good conditions it is actually difficult to obtain a more than 75% mercury emission. In consequence, even when the "GEMEDIS" is used, a total amount of mercury sealed in a tube is decreased only to a lesser degree.

SUMMARY OF THE INVENTION

It is accordingly the object of this invention to provide a mercury emitting structure capable of rapidly emitting most of mercury at a relatively low temperature.

A mercury emitting structure according to this invention comprises an alloy including a novel intermetallic compound consisting principally of yttrium, nickel and mercury and having a crystal structure of a face-centered cubic lattice type (A1 type), and a holder for holding the alloy.

In one aspect of this invention it is possible to obtain during a manufacture of a novel alloy a powder with a desired particle size from an intermetallic compound including yttrium and nickel, without the need of making the compound brittle by a hydrogenation process. In consequence, a very little amount of dissolved gas is included in the intermetallic compound obtained by a reaction of mercury with yttrium and nickel. Since according to this invention the alloy held within a holder consists mainly of an intermetallic compound having a face-centered cubic lattice (A1 type), it is possible to emit mercury, for a relatively short period of time, at a relatively low temperature of 700° to 800° C. If a mercury emitting structure according to this invention is applied to a tube, a tube with excellent characteristics can be obtained at low cost.

BRIEF DESCRIPTION OF THE DRAWING

FIG. 1 is a perspective view showing one example of a mercury emitting structure according to this invention;

FIG. 2 is a cross-sectional view as taken along line II-II in FIG. 1;

FIG. 14 is a perspective view showing a mercury emitting structure with a holder for holding an alloy including the novel intermetallic compound;

FIG. 15 is a cross-sectional view as taken along line III-III in FIG. 14;

FIG. 16 is a cross-sectional view showing another mercury emitting structure according to this invention;

FIG. 17 is a cross-sectional view showing another mercury emitting structure according to this invention; and FIG. 18 is a perspective view showing another mercury emitting structure according to this invention.

DETAILED DESCRIPTION OF THE PREFERRED EMBODIMENTS

Figure 4:
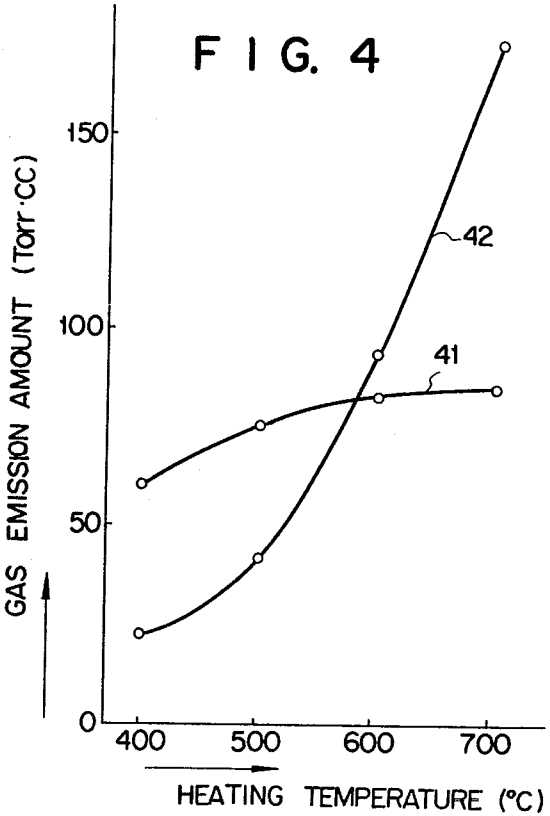
FIG. 4 is a gas emission characteristic showing a relation between a heating temperature and an amount of gas emitted when a novel intermetallic compound having a face-centered cubic lattice in the above-mentioned embodiment is heated.

A mercury emitting structure of this invention comprises an alloy including a novel intermetallic compound consisting mainly of yttrium, nickel and mercury and a holder for holding the alloy. The alloy will now be explained below.

The inventors discovered that an intermetallic compound with a novel face-centered cubic lattice is obtained by reacting with a mercury an intermetallic compound of nickel and a rare earth metal consisting mainly of yttrium and that the application of the novel intermetallic compound to, for example, a tube produces an excellent mercury emission characteristic.

Since the intermetallic compound of the nickel and yttrium does not develop a wide application, a less data on such intermetallic compound is available in the art. A literature on intermetallic compounds such as $Y_3Ni$, $Y_3Ni_2$, $YNi_2$, $YNi_3$, $Y_2Ni_7$, $YNi_5$, $Y_2Ni_{17}$ etc. are reported by F. H. Spedding et al. The inventors prepared $Y_3Ni_2$, $YNi_2$, $YN_3$, $Y_2Ni_7$, $YNi_4$ and $YNi_5$ as intermetallic compounds of yttrium and nickel and these intermetallic compounds were reacted in a reaction vessel with mercury. As a result, the reaction product between mercury and $Y_3Ni_2$, YNi and $YNi_2$ was not stable in the air. In the case of $Y_3Ni_2$ and YNi, in particular, the reaction product was removed from the reaction vessel and after lapse of a few minutes it evolved heat which was gradually changed into red heat. In the case of $YNi_3$, $Y_2Ni_7$, $YNi_4$ and $YNi_5$, on the other hand, the intermetallic compound obtained by reaction with mercury was stable in the air and does not become in red heat state. It is very difficult to singly obtain the intermetallic compound of yttrium and nickel and it was found on an X-ray diffraction that the compound is a mixture comprising some intermetallic compounds.

Examples of this invention will now be explained below.

EXAMPLE 1

88.9g of yttrium and 234.84g of nickel were charged into an alumina crucible and heated at a high frequency vacuum furnace to a temperature of about 1500° C to melt yttrium and nickel. Note that the interior of the furnace was maintained in vacuum up to no more than a temperature of 500° C. When an intra-furnace temperature exceeds 500° C, an argon gas was introduced into the furnace, maintaining an intra-furnace pressure to one atmospheric pressure and preventing evaporation of nickel and yttrium. Upon completion of melting, the melt was cooled at a speed of 100° C/1hr. The surface of the resultant ingot as covered with an oxide layer was removed by polishing. The ingot was hammered into small fragments and further reduced to powder in an iron pot, followed by filtering with a 200-mesh sieve.

100g of powdered intermetallic compound and 40g of mercury were introduced into a quartz tube. After evacuation the quartz tube was sealed. The quartz tube was inserted into an electric furnace and heated for 6 hours at a temperature of 700° C to cause the powdered intermetallic compound to be reacted with mercury. After reaction the product was cooled.

Since an unreacted mercury was contained in the reaction product, the reaction product was removed from the quartz tube and distilled at a temperature of 400° C and the unreacted mercury was recovered from the quartz tube. It was found upon an X-ray diffraction that the intermetallic compound used for reaction with mercury is a mixture of various intermetallic compounds. That is, it is clear that the reaction product of 20 atomic percent of yttrium and 80 atomic percent of nickel mainly includes $YNi_3$, $Y_2Ni_7$ and $YNi_5$, but that it is unclear that the above-mentioned reaction product includes $YNi_4$. It was found upon an X-ray analysis that a crystalline structure of the above-mentioned novel intermetallic compound obtained by the reaction of mercury with the intermetallic compound is a face-centered cubic lattice (A1 type). A diffraction line of $YNi_5$, in addition to the novel intermetallic compound, was revealed in the reaction product, showing that the reaction is not sufficiently effected. The X-ray diffraction data on the novel intermetallic compound is shown in Table 1.

The intermetallic compound according to this invention is not required to be a product completely reacted with mercury and it is only sufficient that the intermetallic compound includes an intermetallic compound consisting of the above-mentioned face-centered cubic lattice. The intermetallic compound according to this invention, which includes yttrium, nickel and mercury, can be expressed by a general formula:

$$Y_xNi_yHg$$

It was found in this example that a nickel to yttrium molar ratio $y/x$ of the obtained intermetallic compound is in a range of 3 to 5.

Table 1

| 2θ | dA | Iobs. | hkl |
|---|---|---|---|
| 21.84 | 4.0660 | m. | 111 |
| 25.28 | 3.5199 | w. | 200 |
| 36.08 | 2.4874 | s. | 220 |
| 42.56 | 2.1223 | v.s. | 311 |
| 44.58 | 2.0307 | m. | 222 |
| 51.93 | 1.7593 | v.v.w. | 400 |
| 57.02 | 1.6137 | v.w. | 331 |
| 58.65 | 1.5727 | v.w. | 420 |
| 64.90 | 1.4355 | m. | 422 |
| 69.40 | 1.3530 | n. | 511, 333 |
| 76.58 | 1.2431 | m. | 440 |

Figure 3:
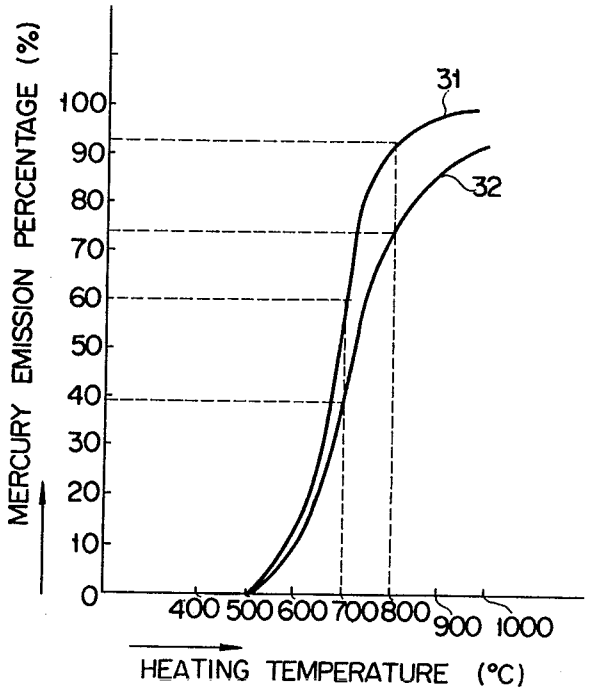
FIG. 3 is a mercury emitting characteristics of the mercury emitting structure in the first embodiment according to this invention by heating in a vacuum ($10^{-4}$ mmHg)

The mercury emission structure in this Example was formed by filling into a holder 12 an alloy 11 consisting mainly of the above-mentioned intermetallic compound in FIGS. 1 and 2. The holder 12 is a receptacle having a groove 13 at the upper end. A curve 31 in a graph of FIG. 3 shows a mercury emission characteristic when the above-mentioned mercury emission structure was heated under a vacuum atmosphere of $10^{-4}$ mmHg. The graph in FIG. 3 plots a temperature as an abscissa and a mercury emission percentage as an ordinate. A curve 32 in FIG. 3 shows a mercury emission characteristic of an intermetallic compound, consisting of mercury and titanium, either shown in the prior art literature or commercially available under the name of "GEMEDIS". Upon comparison, the mercury emission percentage in the curve 31 in FIG. 3 is about 60% at a temperature of 700° C and the mercury emission percentage in the curve 32 in FIG. 3 is about 40% at the temperature of 700° C. The mercury emission percentage is about 90% at a temperature of 800° C in the case of the curve 31 in FIG. 3 and about 70% at the temperature of 800° C in the case of the curve 32 in FIG. 3. As will be evident from the graph in FIG. 3 the alloy consisting mainly of the novel intermetallic compound with the face-centered cubic lattice (Al type) reveals a higher mercury emission percentage at the same temperature and, furthermore, a mercury is effectively emitted for a short time. According to this invention, therefore, mercury can be effectively used due to the effective mercury emission percentage. Note that the mercury content in the alloy in Example 1 is 28% in weight ratio. From the practical viewpoint, however, it will be sufficient that the mercury content is more than 5%.

When an intermetallic compound, consisting of titanium and mercury, shown in the prior art literature is prepared, a large amount of dissolved gas is re-emitted by heat, because powdered titanium is used for a reaction with mercury. This is because that, in order to obtain powdered titanium, the hydrogenation and reduction to powder of titanium are accompanied by dehydrogenation, since it is difficult to reduce titanium to powder if it is present in the form of an elemental form. The powdered titanium, if completely dehydrogenated, includes a hydrogen gas. Even when the powdered titanium is completely dehydrogenated, it is very activated and is likely to absorb a larger amount of gas and in consequence a larger amount of re-emitting gas is involved. In Example 1, on the other hand, the intermetallic compound, made of yttrium and nickel, is very brittle and it obviates the necessity of, as in the case of titanium, effecting hydrogenation, reduction to powder and dehydrogenation of titanium. For this reason, the material used in Example 1 is very preferable. The intermetallic compound with a face-centered cubic lattice (Al type) as obtained by the reaction of mercury with the intermetallic compound including yttrium and nickel involves a lesser amount of dissolved gas.

FIG. 4 is a graph showing a comparison in an amount of gas between the conventional intermetallic compound including titanium and mercury and the intermetallic compound according to this invention. The graph in FIG. 4 is plotted with a heating temperature (°C) as an abscissa and an amount of emitted gas (Torr·cc) as an ordinate. In the graph shown in FIG. 4 a curve 41 shows the amount of emitted gas as plotted at each of temperatures 400°, 500°, 600° and 700° C at which 100g of the intermetallic compound according to this invention was heated for 30 minutes. Likewise, a curve 42 in FIG. 4 shows the amount of emitted gas when 100g of the conventional intermetallic compound was measured under the above-mentioned conditions. Although the amount of emitted gas at each temperature is plotted for every 30 minutes, a major amount of gas was actually emitted for about 5 minutes. In the graph of FIG. 4, the intermetallic compound (curve 41) according to this invention emits a large amount of gas at the temperature of 400° to 500° C and at the temperature above 500° C a very small amount of gas is emitted. In contact, the conventional intermetallic (curve 42) compound including titanium and mercury shows a gradual emission of gas up to no more than a temperature of 700° C.

In a tube manufacturing process, in general, an evacuation temperature is set at the temperature of 400° to 500° C and, in consequence, the intermetallic compound according to this invention can emit a dissolved gas during an evacuation process and almost no impure gas is present in the tube. During the tube manufacturing process, the intermetallic compound is decomposed by induction heating, when the sealing of the tube is completed, and heated to a temperature of about 900° C, causing mercury to be liberated from the intermetallic compound within the tube. Where use is made, in this case, of the conventional intermetallic compound including titanium and mercury, a greater amount of gas is emitted for a low-pressure mercury vapour discharge tube, therefore, a high starting voltage is involved and there is a chance that a tube will not be lighted. Since a gas emitted during the liberation of mercury is deposited onto parts, a film on a screen and soon within the tube, desorption of gas occurs during the lighting of the tube, leading to what is called "end band". In consequence, a tube quality is degraded during the service life. According to this invention, however, such drawbacks are eliminated.

When the mercury bearing intermetallic compound is sealed within the tube and mercury is liberated, by high frequency heating, from the intermetallic compound, a gas is still emitted from the intermetallic compound and, therefore, it is necessary to make in coexistence with the intermetallic compound a getter for adsorbing the emitting gas.

For the intermetallic compound according to this invention less getter can be used due to a lesser amount of emitted gas and a low cost results. The use of a lesser amount of getter requires no extra space to be formed in the holder and no dimensional restriction is made with respect to the tube.

As will be evident in Example 1 the mercury emitting structure with the holder having an alloy including the abovementioned intermetallic compound having the face-centered cubic lattice (Al type) can effectively utilize a mercury due to a greater mercury emitting rate and also be applied to a rapid-speed tube manufacturing equipment. There is no disadvantage that the tube starting voltage will become higher due to a lesser amount of emitted gas and, in addition, it is possible to save a getter to be used in the tube.

EXAMPLE 2

100.6g of yttrium and 199.4g of nickel were charged in an alumina crucible and heated at the high frequency vacuum furnace to a temperature of about 1500° C to melt yttrium and nickel. The furnace was maintained in vacut up to no more than a temperature of 500° C. When the furnace temperature exceeds 500° C, an argon gas was introduced to maintain a intra-furnace pressure to 1 atmosphere, preventing evaporation of yttrium and nickel. Upon completion of melting, the melt was cooled at a rate of about 100° C/hr until it was solidified, and allowed to be cooled by interrupting a power source. An oxide film covered on the surface of the resulting ingot is removed by polishing. Then, the ingot is hammered into small fragments. The fragments were introduced in the iron pot and further reduced to powder followed by filtering through a 200 mesh sieve.

Figure 5:
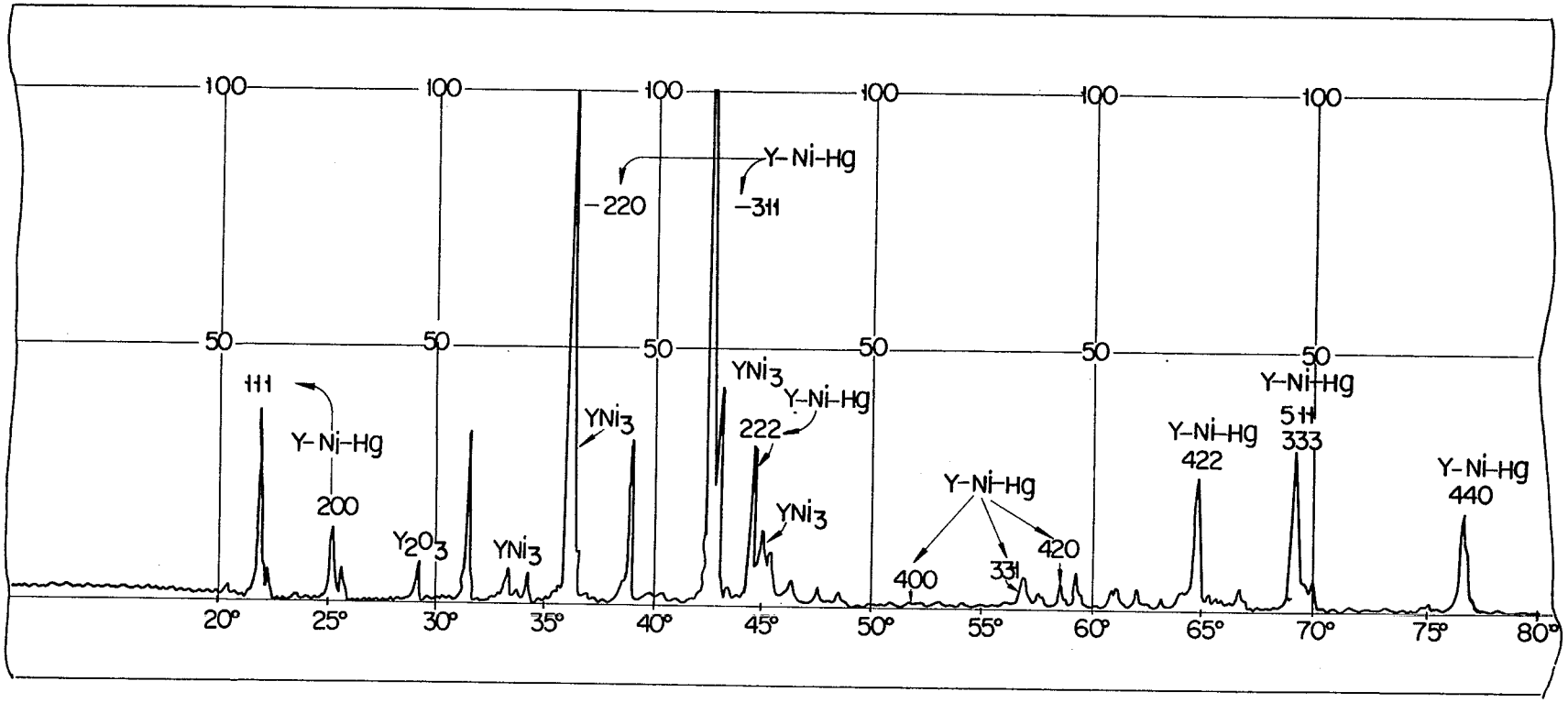
FIG. 5 is an X-ray diffraction diagram showing a novel intermetallic compound in a second embodiment according to this invention.

In the same procedure as in Example 1, the reaction and distillation were carried out to obtain an intermetallic compound including yttrium, nickel and mercury. Note that a mercury content in the reaction product was 27.1 weight percent. It was found upon analysis of an X-ray diffraction diagram in FIG. 5 that the novel intermetallic compound has a face-centered cubic lattice. In the X-ray diagram in FIG. 5 a diffraction line of $YNi_3$, in addition of the above-mentioned novel intermetallic compound, was revealed, showing that the reaction is not sufficiently effected. In the graph shown in FIG. 5 a diffraction angle in Table 1 is plotted as an abscissa and an X-ray scattering intensity is plotted as an ordinate with a 3-digit figure representing a face index of a lattice crystal face. It will be apparent in FIG. 5 that the novel intermetallic compound is a face-centered cubic lattice.

Figure 6:
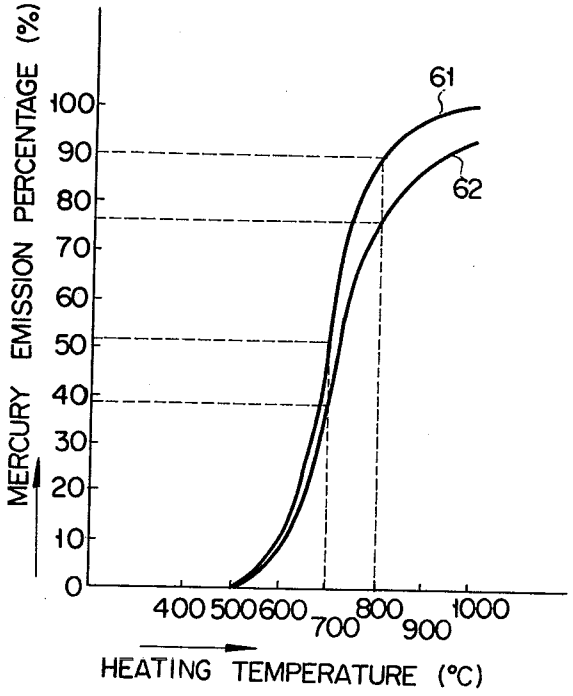
FIG. 6 is a view showing the mercury emission characteristic of a novel intermetallic compound when the intermetallic compound in the second embodiment is heated under the same condition as in FIG. 3.

FIG. 6 shows the mercury emission characteristic of the novel intermetallic compound in Example2. In the graph shown in FIG. 6 a curve 61 shows the mercury emission characteristic of the novel intermetallic compound in Example 2 and a curve 62 shows the mercury emission characteristic of the conventional intermetallic compound including titanium and mercury. Note that, in both the cases, the mercury emission characteristic was obtained in a vacuum atmosphere of $10^{-4}$ mmHg. Upon comparison, the curve 61 is located above the curve 62 with a temperature of 500° C as a reference point. For example, for a temperature of 700° C the mercury emission percentage is about 52% in the curve 61 in FIG. 6 and about 38% in the curve 62 in FIG. 6 and, for a temperature of 800° C the mercury emission percentage is about 90% in the curve 61 and about 76% in the curve 62. Thus, the novel intermetallic compound in Example 2 is excellent in mercury emission over the conventional intermetallic compound and has substantially the same advantages as in the case of Example 1.

EXAMPLE 3

90.6g of yttrium and 209.4g of nickel were charged in the alumina crusible and, after melted, cooled as in Examples 1 and 2 followed by filtering through a 200 mesh sieve. In the same method as in Example 1 the reaction, distillation etc. were effected as in the abovementioned Example, to obtain a novel intermetallic compound including yttrium, nickel and mercury. Note that a mercury content in the reaction product was 23.7 weight percent.

Figure 7:
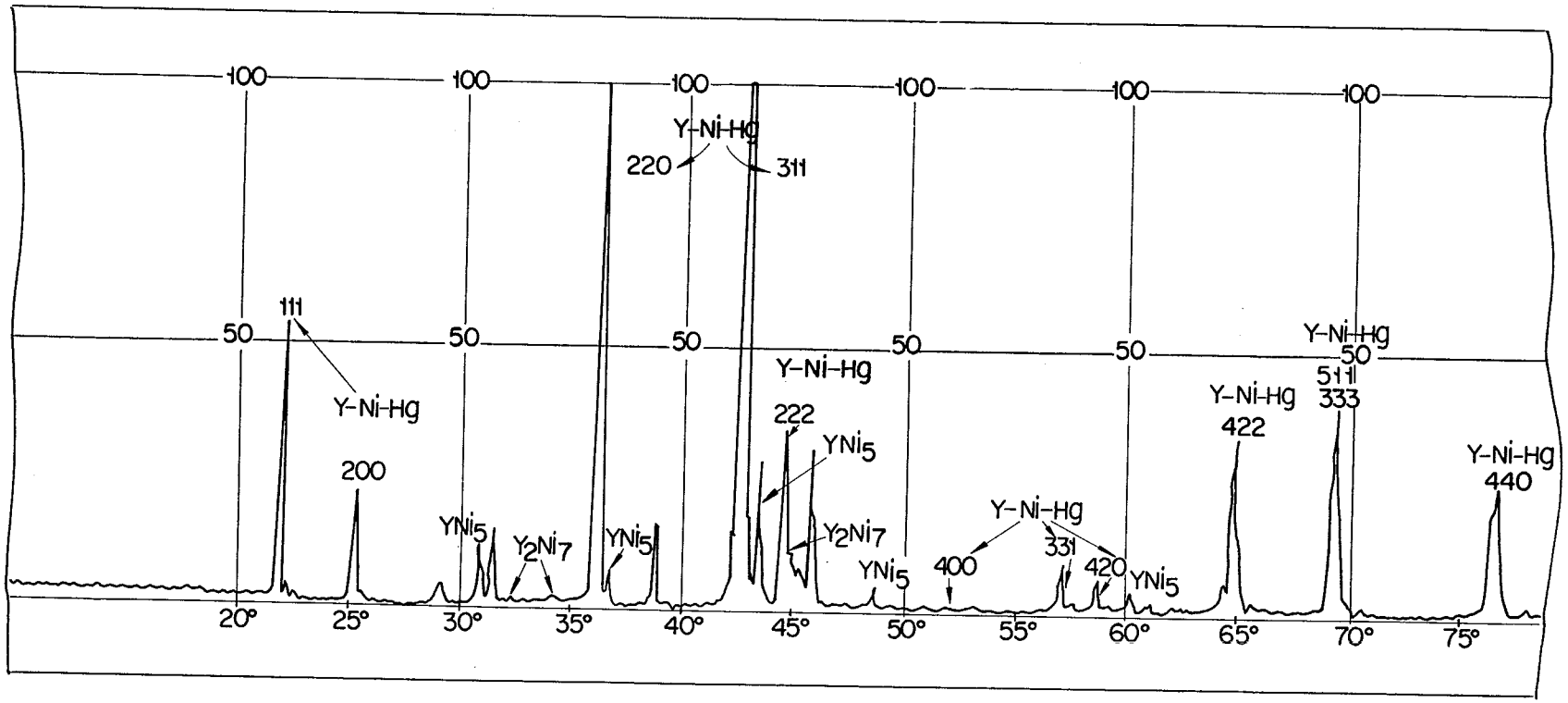
FIG. 7 is an X-ray diffraction diagram showing a third novel intermetallic compound in a third embodiment according to this invention.

It was found upon analysis of an X-ray diagram in FIG. 7 that the novel intermetallic compound has a face-centered cubic lattice. In the X-ray diagram in FIG. 7, a diffraction line of $Y_2Ni_7$ (indicating that the reaction is sufficiently effected) and $YNi_5$ (considered as an unreacted product), in addition to the novel intermetallic compound, is revealed. It will be understood from the Miller indices in FIG. 7 that the novel intermetallic compound has a face-centered cubic lattice.

Figure 8:
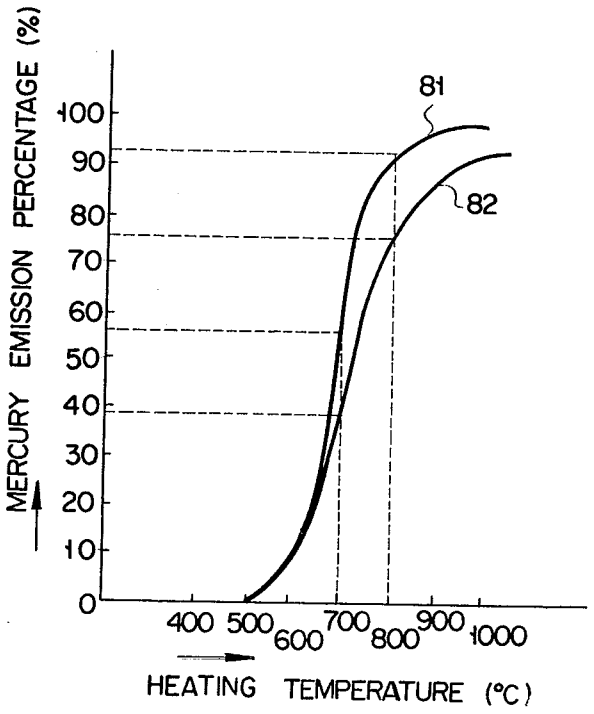
FIG. 8 is a graph showing the mercury emission characteristic of a novel intermetallic compound in the third embodiment when the compound is heated under the same condition as in FIG. 3.

FIG. 8 shows the mercury emission characteristic of the intermetallic compound in Example 3 and a conventional intermetallic compound including titanium and mercury. Note that the mercury emission characteristic was obtained in a vacuum atmosphere of $10^{-4}$ mmHg. A curve 81 shows the mercury emission characteristic of the intermetallic compound in Example 3 and a curve 82 shows the mercury emission characteristic of the conventional intermetallic compound. Upon comparison, the curve 81 is located above the curve 82 with a temperature of about 500° C as a reference point. For example, for a temperature of 700° C the mercury emission percentage is about 55% in the curve 81 and about 38% in the curve 82 and, for a temperature of 800° C, the mercury emission percentage is about 93% in the curve 81 and 76% in the curve 82. The novel intermetallic compound in Example 3 is excellent in mercury emission efficiency over the conventional intermetallic compound and substantially the same advantages as in Example 1 can be obtained.

EXAMPLE 4

86.1g of yttrium and 213.9g of alumina crusible were charged in the alumina crucible and, after heated and melted, cooled as in Example, followed by passing through a 200 mesh sieve. In the same method as in Example 1, the reaction, distillation etc. were conducted to yield a novel intermetallic compound including yttrium and nickel. A mercury content in the reaction product was 23.0 weight percent.

Figure 9:
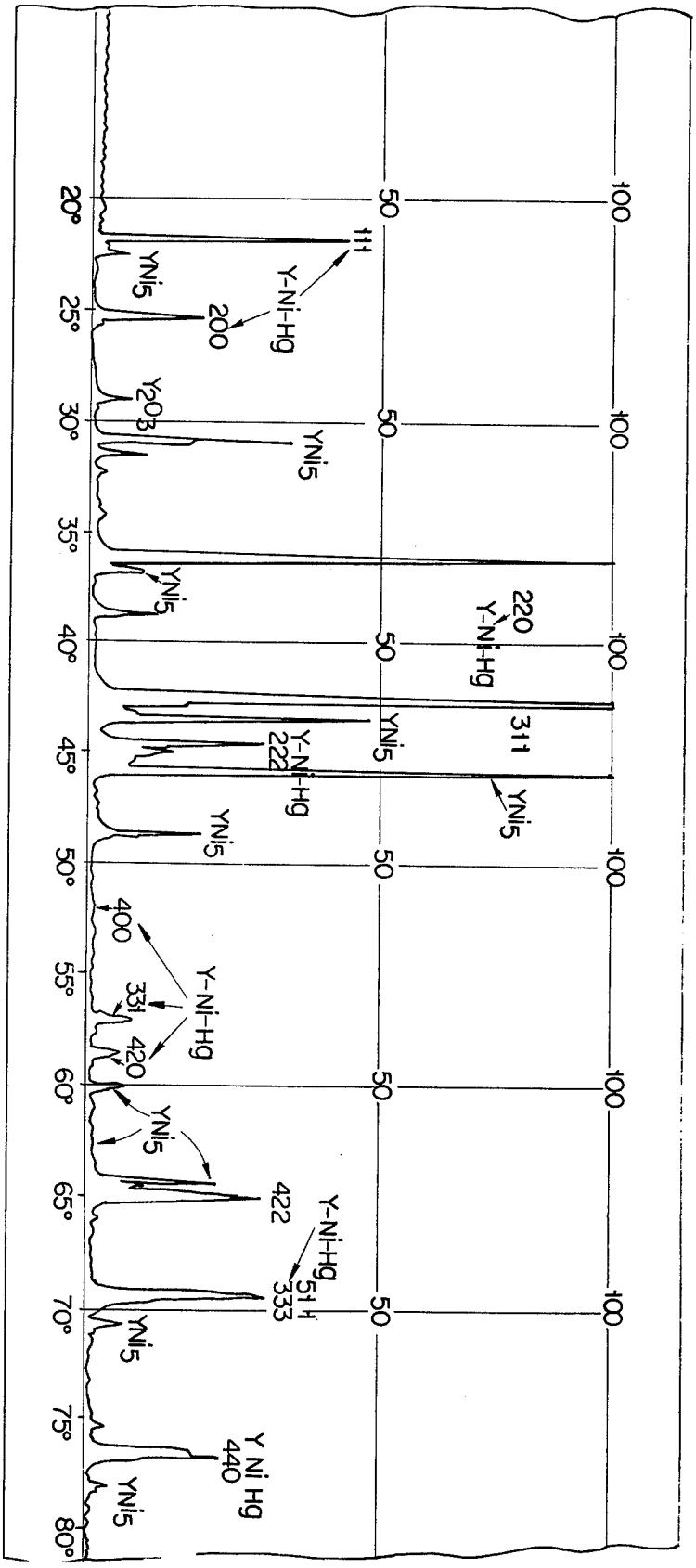
FIG. 9 is an X-ray diffraction diagram showing a novel intermetallic compound in a fourth embodiment according to this invention.
Figure 10:
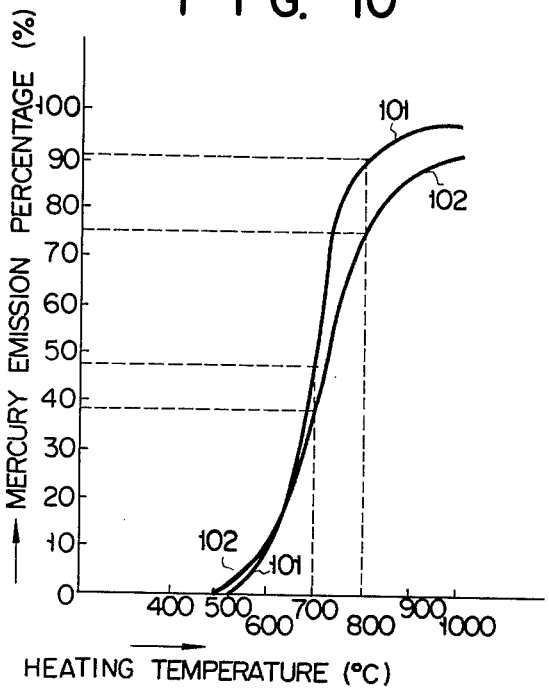
FIG. 10 is a graph showing a mercury emission characteristic of a novel intermetallic compound in the fourth embodiment when the compound is heated under the same condition as in FIG. 3.

It will be found upon analysis of an X-ray diagram in FIG. 9 that the novel intermetallic compound has a face-centered cubic lattice. In the X-ray diagram in FIG. 9 a diffraction line of $YNi_5$ (considered as an unreacted material) in addition to the novel intermetallic compound, is revealed. It will be evident from a face index in FIG. 9 that the novel intermetallic compound has a face-centered cubic lattice. FIG. 10 is a graph showing the mercury emission characteristic of the novel intermetallic compound in Example 4. Note that the mercury emission characteristic was obtained under a vacuum atmosphere of $10^{-4}$ mmHg. In the graph shown in FIG. 10 a curve 101 shows the mercury emission characteristic of the novel intermetallic compound in Example 4 and a curve 102 shows the mercury emission characteristic of a conventional intermetallic compound including titanium and mercury. Upon comparison the curve 101 is located above the curve 102 with a temperature of about 600° C as a reference. For example, for a temperature of 700° C mercury emission rate is about 48% in the curve 101 and 38% in the curve 102 and, for a temperature of 800° C, the mercury emission percentage is about 91% in the curve 101 and about 76% in the curve 102. The novel intermetallic compound is excellent in mercury emission percentage over the conventional intermetallic compound and substantials the same advantages as in Example 1 are obtained.

EXAMPLE 5

79.8g of yttrium and 220.2g of nickel were charged in the alumina crusible and, after heated and melted, cooled and reduced to powder as in Example 1, followed by passing through a 200 mesh sieve. In the same method as in Example 1, the reaction, distillation etc. were conducted to produce an intermetallic compound including yttrium, nickel and mercury. A mercury content in the reaction product was 20.6%.

Figure 11:
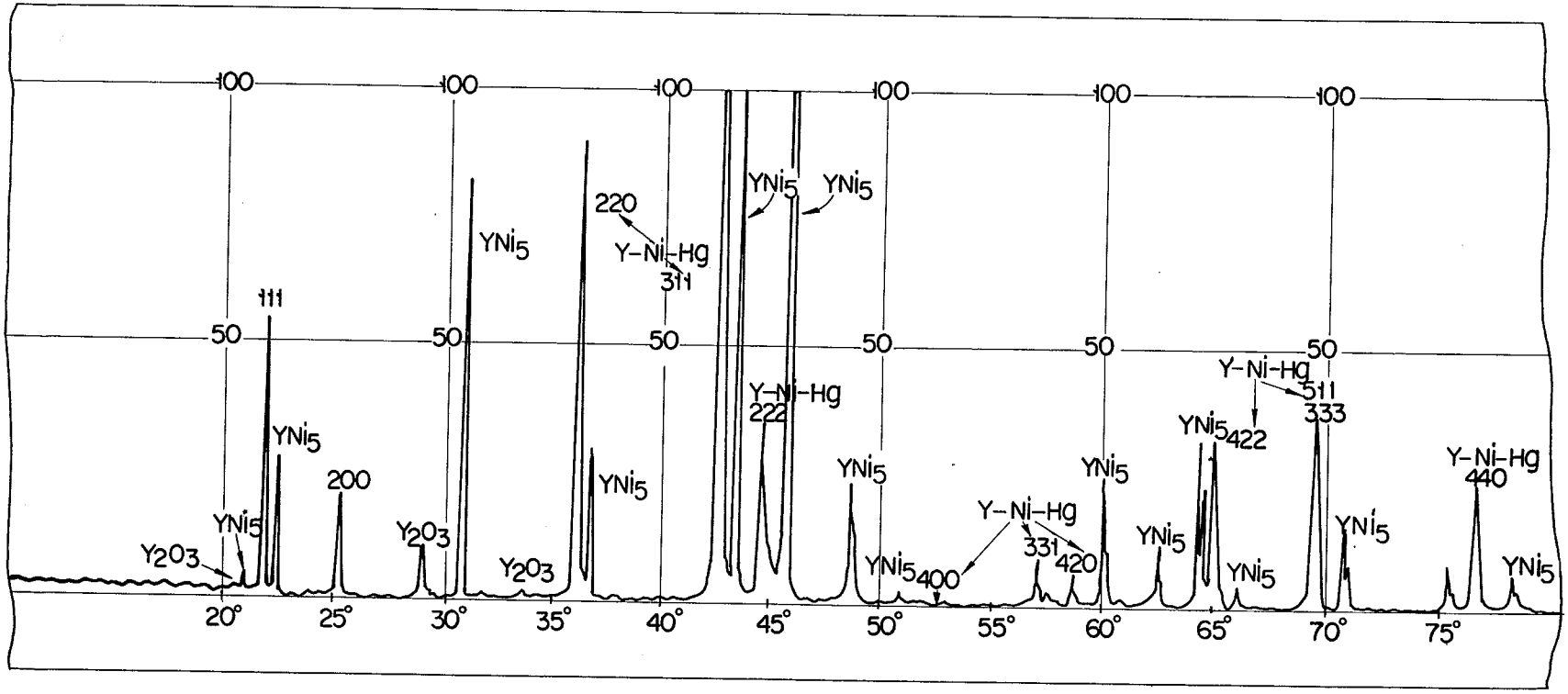
FIG. 11 is an X-ray diffraction diagram showing an intermetallic compound in a fifth embodiment according to this invention.

It was found upon analysis of an X-ray diagram in FIG. 11 that the novel intermetallic compound has a face-centered cubic lattice and, in the X-ray diffraction diagram, a diffraction line of $YNi_5$ (considered as an unreacted product), in addition to the novel intermetallic compound, is shown. It will be evident from a face index in FIG. 11 that the intermetallic compound has a face-centered cubic lattice.

Figure 12:
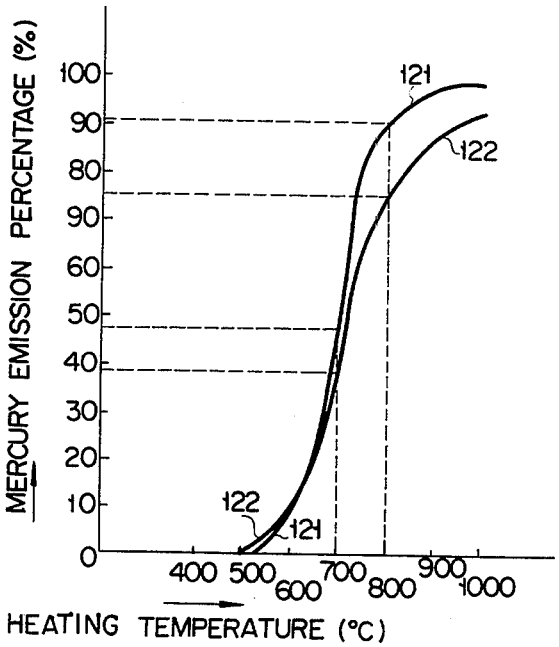
FIG. 12 is a graph showing the mercury emission characteristic of a novel intermetallic compound in the fifth embodiment when the compound is heated under the same condition as in FIG. 3.

FIG. 12 shows the mercury emission characteristic of the novel intermetallic compound in Example 5. Note that the mercury emission characteristic was obtained under a vacuum pressure of $10^{-4}$mmHg. A curve 121 in FIG. 12 shows the mercury emission characteristic of the novel intermetallic compound in Example 5, whereas a curve 122 in FIG. 12 shows the mercury emission characteristic of a conventional intermetallic compound including titanium and mercury. Upon comparison the curve 121 is located above the curve 122 with a temperature of about 600° C as a reference point. For example, for a temperature of 700° C the mercury emission percentage is about 48% in the curve 121 and, for a temperature of 800° C, the mercury emission percentage is about 91% in the curve 121 and about 76% in the curve 122. The novel intermetallic compound in Example 5 is excellent in mercury emission efficiency over the conventional intermetallic compound and has advantages substantially equal to these as in Example 1.

In the above-mentioned Examples 1 to 5 each of the intermetallic compounds comprises yttrium, nickel and mercury, but in the following Example the intermetallic compound was prepared using a powdered alloy including any combination of many kinds of rare earth elements.

EXAMPLE 6

Use was made of a powdered alloy comprising nickel and various kinds of rare earth elements (for example, yttrium 63.0%, dysprosium 9.2%, erbium 7.0%, neodimium 5.4%, gadolinium 3.5%, cerium 2.7% , praseodymium 2.4%, holmium 2.0%, thulium 1.7% and a remainder 3.1% -weight percent-). In the same method as in Example 1, reaction was conducted.

93g of such various kinds of rare earth metals and 234g of nickel were charged in the alumina crucible followed by heating, melting, cooling and reduction to powder. As a result, powdered alloy considered as various kinds of intermetallic compounds were obtained.

In the same procedure as in Example 1, the reaction, distillaton etc. were carried out to obtain a novel intermetallic compound including various kinds of metal elements. It was found upon analysis of an X-ray diffraction that the novel intermetallic compound has a face-centered cubic lattice (Al type).

Figure 13:
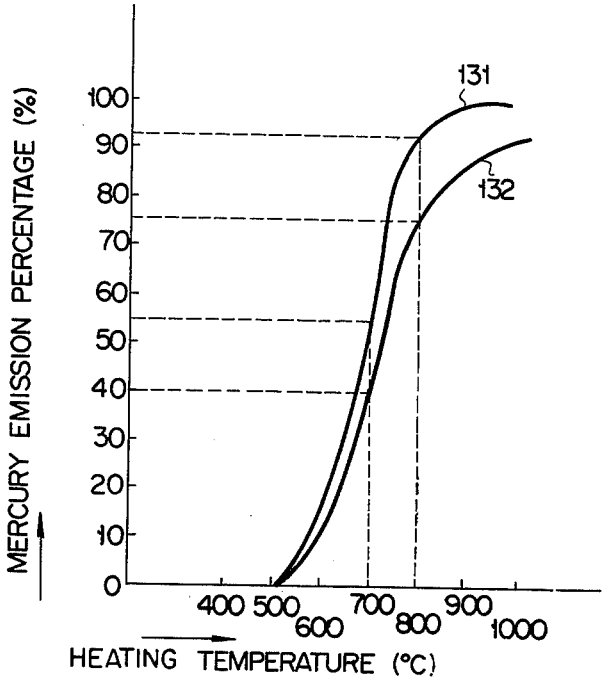
FIG. 13 is a graph showing the mercury emission characteristic of a novel intermetallic compound in the sixth embodiment when the compound is heated under the same conditions as in FIG. 3.

FIG. 13 is a graph showing the mercury emission characteristic of the novel intermetallic compound in FIG. 1 as obtained in the same method as in Example 1. In the graph shown in FIG. 13 a curve 131 shows the mercury emission characteristic of the novel intermetallic compound, whereas a curve 132 shows the mercury emission characteristic of a conventional intermetallic compound including titanium and mercury. Upon comparison, the curve 131 is located above the curve 132 with a temperature of about 500° C as a reference point. For example, for a temperature of 700° C the silver emission percentage is about 55% in the curve 131 and about 40% in the curve 132 and for a temperature of 800° C the silver emission percentage is about 92% in the curve 131 and about 76% in the curve 132. The novel intermetallic compound in FIG. 6 is excellent in mercury emission percentage over the conventional intermetallic compound and has substantially the same advantages as in Example 1.

From the above it will be understood that the novel intermetallic compound can emit most of mercury at the temperature of 700° to 800° C.

The mercury emitting structure according to this invention is formed by inserting into a holder the alloy including the face-centered cubic lattice (Al type) consisting mainly of yttrium, nickel and mercury. The shape, size etc. of the holder can be changed in a variety of ways according to the object to which this invention is directed.

FIG. 14 shows a mercury emitting structure according to this invention comprising a holder 143 made of a square metal (for example, iron) plate 141 having a recess circular in cross section and the above-mentioned alloy 144 introduced into the recess of the holder 143. This invention can be use a conventionally available holder formed of a plate, ribbon, filament, coil etc. (all of which are made of metal) and the other holder as well as a holder directed to various object of this invention.

A mercury emitting structure according to this invention comprises a holder 162, as shown in FIG. 16, having, for example, a powdered metal 161, powdered titanium and the other metal, having a getter capability and an alloy comprising the above-mentioned intermetallic compound having a face-centered cubic lattice (Al type). A holder 173 according to this invention may be formed by disposing, for example, a mixed layer 172 of titanium and the above-mentioned alloy, as shown in FIG. 17, on a mixed layer 171 of above-mentioned powdered metal and the above-mentioned alloy. Separate holders 183 and 184 respectively having a powdered metal (Al a getter capability and the above-mentioned face-centered cubic lattice (Al type) may be sealed in coexistence relation in a tube. The metal with a getter capability may be provided in the form of powder, wire, plate, ribbon, pellet etc.

If the mercury emitting structure according to this invention is applied to a tube such as a low-pressure mercury vapor discharge tube etc., since the tube sealing process of the tube manufacture is effected at a temperature of about 800° C, the mercury emitting structure can efficiently emit for a short period of time at a relatively low temperature of 700° to 800° C as will be apparent from the mercury emission characteristic in the above-mentioned Examples. In the manufacture of a low-pressure vapor discharge tube which is effected at rapid speed, the operation is very smoothly effected without involving evaporation of the metals in the holder. As a result, it is possible to obtain a low-pressure vapor discharge tube excellent in characteristics and a saving in manufacturing cost can also attained.

The mercury emitting structure can be applied to a nixi tube and the other mercury-sealed tube as well as the manufacture of these tubes. A metal other than nickel can be used if it can form an intermetallic compound by reaction with yttrium and mercury.

This invention is not restricted to the above-mentioned embodiment and various changes and modifications can be made without departing from the spirit and scope of this invention.

What we claim is:

1. A mercury emitting structure comprising an alloy of an intermetallic compound having a face centered cubic lattice type crystal structure of the Al type, said alloy being yttrium, nickel and mercury, and a holder for holding said alloy.

2. A mercury emitting structure according to claim 1 in which a molar ratio of nickel to yttrium is in a range of 3 to 5.

3. A mercury emitting structure according to claim 1 in which said alloy includes other rare earth elements.

4. A mercury emitting structure according to claim 3 in which said other rare earth elements are dysprosium, erbium, neodymium, gadolinium, cerium, praseodymium, holmium and thulium.

5. A mercury emitting structure according to claim 1, further including a getter having a desired size and dimension.

6. A mercury emitting structure according to claim 1 in which said holder is an annular metal receptacle having a groove at the upper end.

7. A mercury emitting structure according to claim 1 in which said holder is a square metal having a recess at the center thereof.

8. A low pressure mercury vapor discharge tube including a mercury emitting structure as claimed in claim 1.

9. A mercury emitting structure comprising a metal powdered mixture including a powdered alloy consisting mainly of yttrium, nickel and mercury and a powdered metal having a getter capability in a holder for holding the mixture.

10. A mercury emitting structure comprising a first mixture of a powdered alloy consisting mainly of yttrium, nickel and mercury and a first powdered metal having a getter capability, a second mixture of said powdered alloy and a second powdered metal having a getter capability, and a holder in which said first and second mixtures are received one upon the other in a two-layer fashion.

11. A mercury emitting structure comprising a first holder having an alloy including an intermetallic compound having a face centered cubic lattice type structure of the Al type, consisting mainly of yttrium, nickel and mercury and a second holder having a powdered metal having a getter capability.

* * * * *